US006410839B2

(12) United States Patent
Okubo et al.

(10) Patent No.: US 6,410,839 B2
(45) Date of Patent: Jun. 25, 2002

(54) APPARATUS AND METHOD FOR AUTOMATIC MUSICAL ACCOMPANIMENT WHILE GUIDING CHORD PATTERNS FOR PLAY

(75) Inventors: Rika Okubo, Kawasaki; Takashi Yahata, Hamura, both of (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/732,367

(22) Filed: Dec. 7, 2000

(30) Foreign Application Priority Data

Dec. 21, 1999 (JP) ..... 11-363506
Sep. 14, 2000 (JP) ..... 2000-279148

(51) Int. Cl.[7] ..... G10H 1/38
(52) U.S. Cl. ..... 84/637; 84/DIG. 22
(58) Field of Search ..... 84/613, 637, DIG. 22

(56) References Cited

U.S. PATENT DOCUMENTS 4,480,521 A 11/1984 Schmoyer
5,085,118 A * 2/1992 Sekizuka ..... 84/637 X
5,218,157 A * 6/1993 Akagawa et al. ..... 84/637
5,235,126 A * 8/1993 Bruti et al. ..... 84/637 X
5,491,298 A * 2/1996 Eiichiro ..... 84/DIG. 22
5,641,928 A * 6/1997 Tohgi et al. ..... 84/613
6,093,881 A * 7/2000 Fay et al. ..... 84/613 X
6,153,821 A * 11/2000 Fay et al. ..... 84/637 X

FOREIGN PATENT DOCUMENTS

JP 57-125995 8/1982

* cited by examiner

*Primary Examiner*—Stanley J. Witkowski
(74) *Attorney, Agent, or Firm*—Frishauf, Holtz, Goodman & Chick, P.C.

(57) ABSTRACT

A musical instrument and a method for automatically playing a musical accompaniment by guiding smoother and easier chord patterns to play. The present invention indicates chord forms which realize smoothest fingering after analyzing a chord following the present chord to determine whether the present chord should employ a root position or an inverted position for the smoothest fingering. Another feature of the present invention is to indicate chord forms which are selected to realize less movement of the player's hand after analyzing the former chord to determine a chord position (root position or inverted position) of the present chord which is the closest to the former position.

4 Claims, 14 Drawing Sheets

| MEASURE | BEAT | CHORD |
|---|---|---|
| 1 | 1<br>2<br>3<br>4 | C |
| 2 | 1<br>2<br>3<br>4 | F |
| 3 | 1<br>2<br>3<br>4 | C |
| 4 | 1<br>2<br>3<br>4 | G7 |

FIG.2

TBL 1

| CHORD | INVERSION TYPE | CHORD TONE | | | |
|---|---|---|---|---|---|
| C | R | C2 | E2 | G2 | - |
| | I | E2 | G2 | C3 | - |
| | II | G2 | C3 | E3 | - |
| | - | - | - | - | - |
| F | R | F2 | A2 | C3 | - |
| | I | A2 | C3 | F3 | - |
| | II | C2 | F2 | A2 | - |
| | - | - | - | - | - |
| C | R | C2 | E2 | G2 | - |
| | I | E2 | G2 | C3 | - |
| | II | G2 | C3 | E3 | - |
| | - | - | - | - | - |
| G7 | R | G2 | B2 | (D3) | F3 |
| | I | - | - | - | - |
| | II | (D2) | F2 | G2 | B2 |
| | III | F2 | G2 | B2 | (D3) |

FIG.3

| MEASURE | BEAT | CHORD |
|---|---|---|
| 1 | 1<br>2<br>3<br>4 | Cadd9<br>C+7 |
| 2 | 1<br>2<br>3<br>4 | Fmaj7 |
| 3 | 1<br>2<br>3<br>4 | Bm7-5<br>E7 |
| 4 | 1<br>2<br>3<br>4 | Asus4<br>Amadd9 |

FIG.9

TBL2

| CHORD | ASSIGNED KEY |
|---|---|
| Cadd9<br>C+7 | C<br>D |
| Fmaj7 | E |
| Bm7-5<br>E7 | F<br>G |
| Asus4<br>Amadd9 | A<br>B |

FIG.10

Cadd9

C7+

Fmaj7

Bm7-5

APPARATUS AND METHOD FOR AUTOMATIC MUSICAL ACCOMPANIMENT WHILE GUIDING CHORD PATTERNS FOR PLAY

BACKGROUND OF THE INVENTION

1. Field of the Invention

The present invention relates to a musical instrument and method for automatic musical accompaniment with indicating chord fingerings.

2. Description of the Related Art

Conventionally, a keyboard musical instrument is known which automatically outputs preset accompaniment patterns (for example, backing part (middle range chord) and bass part) with shifting pitches in accordance with chords designated by a player.

Some such keyboard musical instruments are designed for beginners which allow a player to designate desired chords with simplified fingering (hereinafter, referred to as simple fingering mode). Usually, keys on the keyboard are divided into two areas. One for accompaniment (harmony) (hereinafter, referred to as accompaniment area), and the other for melody playing etc. Generally, keys lower than a predetermined key form the accompaniment area. Some chords are assigned to predetermined keys in the accompaniment area. The predetermined keys function as chord designation switches. Therefore, the player can play chords with easy operation. For advanced players, so-called fingered chord mode is also available. It requires a player to press keys in the accompaniment area in accordance with full-chord fingerings.

Recently, keyboard musical instruments having a fingering guide function have been in use. Such keyboard outputs, for example, accompaniment patterns represented by chord data (indicating root and chord type) in accordance with measures and beats in a score are synchronous with predetermined tempo. At the same time, keys to be pressed are lit by an LED or the like in accordance with the output chord data to indicate fingering position.

Those conventional keyboard musical instruments have the following problems (a) to (c).

(a) In a case where a player plays accompaniments by referring to a sample accompaniment pattern present in the instrument under the fingered chord mode, it always allows only root position fingering, because the lowest note of each chord is always regarded as a root note. In other words, it is not compatible with inverted chords which are helpful for smooth fingering. As a result, the player must play chords with awkward fingering.

(b) Even in a case of the simple fingering mode, it is difficult for a beginner player who has not previously played accompaniment to play chords for playing accompaniment at proper timings. Therefore, it is not suitable for practicing on accompaniment.

(c) In case of the fingering guide type wherein proposed keys are lit just before a key depression timing, accompaniment pattern (chord progression) is built based on root position chords. Such a root position oriented accompaniment pattern often requires a player to move his/her hand widely to press lit keys. It causes difficulties for a beginner player who is not familiar with chord fingerings.

SUMMARY OF THE INVENTION

It is an object of a first aspect of the present invention to provide a musical instrument which conducts operations for playing chords with smooth chord position changes.

More precisely, the musical instrument for automatically playing a musical accompaniment according to the first aspect of the present invention comprises:

an accompaniment pattern storage unit which stores chord progression of a musical accompaniment;

a chord position storage unit which stores chord position data corresponding to the chords in the accompaniment pattern storage unit, the chord position data include chord tone sets corresponding to root position and inverted positions for each chord;

a chord position determining unit which reads a first chord of the chord progression from the accompaniment pattern storage unit, and analyzes a second chord to be played next to the first chord, to determine whether the root position or the inverted position should be selected for the smoothest chord playing; and a pitch indicator which indicates pitches in the chord tone set of the first chord in accordance with the chord position determined by the chord position determining unit.

It is an object of a second aspect of the present invention to provide a musical instrument which provides chord positions and timings of playing chords.

More precisely, the musical instrument for automatically playing a musical accompaniment according to the second aspect of the present invention comprises:

an accompaniment pattern storage unit which stores chord progression of a musical accompaniment;

a chord reader which reads out chords to be played from the accompaniment pattern storage unit being synchronous with predetermined tempo;

an operation conductor which conducts operations to designate chords read by the chord reader; and a timing indicator which indicates timings of performing the operation conducted by the operation conductor.

It is an object of a third aspect of the present invention to provide a musical instrument which conducts operations for playing chords easily.

More precisely, the musical instrument for automatically playing a musical accompaniment comprising:

an accompaniment pattern storage unit which stores chord progression of a musical accompaniment;

a chord position storage unit which stores chord position data corresponding to the chords in the accompaniment pattern storage unit, the chord position data include chord tone sets corresponding to a root position and inverted positions for each chord;

a note selector which extracts chord tone sets including a root position and inverted positions of a second chord in the chord progression from the chord position storage unit, and selects a note in the extracted chord tone sets of the second chord which is the closest to a first chord whose operation has already been conducted; and an operation conductor which indicates pitches of the chord tone set including the note selected by the note selector.

In this case, the musical instrument may further comprise note designators which designate notes available by the musical instrument, wherein the selector may previously obtain first position of one of the note designator which designates a middle note between the highest and the lowest notes in the chord tone set of the first chord, obtain second positions of the note designators which designates middle notes between the highest and the lowest notes of the chord tone sets of the second chord, and select one of the chord tone sets of the second chord including the note corresponding to one of the second positions which is the closest to the first position.

It is an object of a fourth aspect of the present invention to provide a method for conducting operations for playing chords with smooth chord position changes.

More precisely, the method for automatically playing a musical accompaniment according to the fourth aspect of the present invention comprises the steps of:

reading a first chord in chord progression in accordance with a musical accompaniment to be played which is stored in an accompaniment pattern storage unit;

analyzing a second chord following to the first chord to determine whether the first chord should employ a root position or an inverted position to realize the smoothes the chord playing, and obtaining a chord tone set of the first chord corresponding to the determined chord position from a chord position storage unit which stores chord tone sets including root position and inverted positions for each chord corresponding to the chord progression stored in the accompaniment pattern storage unit; and guiding pitches of the determined chord tone set of the first chord.

It is an object of a fifth aspect of the present invention to provide a method for conducting chord positions and timings of playing chords.

More precisely, the method for automatically playing a musical accompaniment according to the fifth aspect of the present invention comprises the steps of:

reading chords to be played with synchronizing with predetermined tempo from an accompaniment pattern storage unit which stores chord progression of a musical accompaniment;

conducting operations for designating the read chords;

indicating timings for performing the conducted operations for the read chords.

It is an object of a sixth aspect of the present invention to provide a method for conducting operations for playing chords easily.

More precisely, the method for automatically playing a musical accompaniment according to the sixth aspect of the present invention, which conducts operations for playing chords which are read-out from an accompaniment storage unit which stores chord progression for a musical accompaniment, comprises the steps of:

extracting chord tone sets including a root position and inverted positions of a second chord in the chord progression from the chord position storage unit, and selecting a note in the extracted chord tone sets of the second chord which is the closest to a first chord whose operation has already been conducted; and indicating pitches of the chord tone set including the selected note.

In this case, available notes for playing the chords may be designated by note designators; and the note selecting step may previously obtain first position of one of the note designator which designates a middle note between the highest and the lowest notes in the chord tone set of the first chord, obtain second positions of the note designators which designates middle notes between the highest and the lowest notes of the chord tone sets of the second chord, and select one of the chord tone sets of the second chord including the note corresponding to one of the second positions which is the closest to the first position.

BRIEF DESCRIPTION OF THE DRAWINGS

These objects and other objects and advantages of the present invention will become more apparent upon reading of the following detailed description and the accompanying drawings in which:

FIG. 2 is a diagram exemplifying accompaniment pattern (chord progression) according to the first embodiment;

FIG. 3 is a diagram exemplifying contents in a table TBL 1 for searching chord form;

FIG. 9 is a diagram exemplifying accompaniment pattern (chord progression) according the second embodiment;

FIG. 10 is a diagram exemplifying contents in a table TBL2;

DETAILED DESCRIPTION OF THE PREFERRED EMBODIMENTS

Embodiments employing the musical instrument and method for automatic musical accompaniment of the present invention will now be described with reference to FIGS. 1 to 16.

First Embodiment (1) Structure

Figure 1:
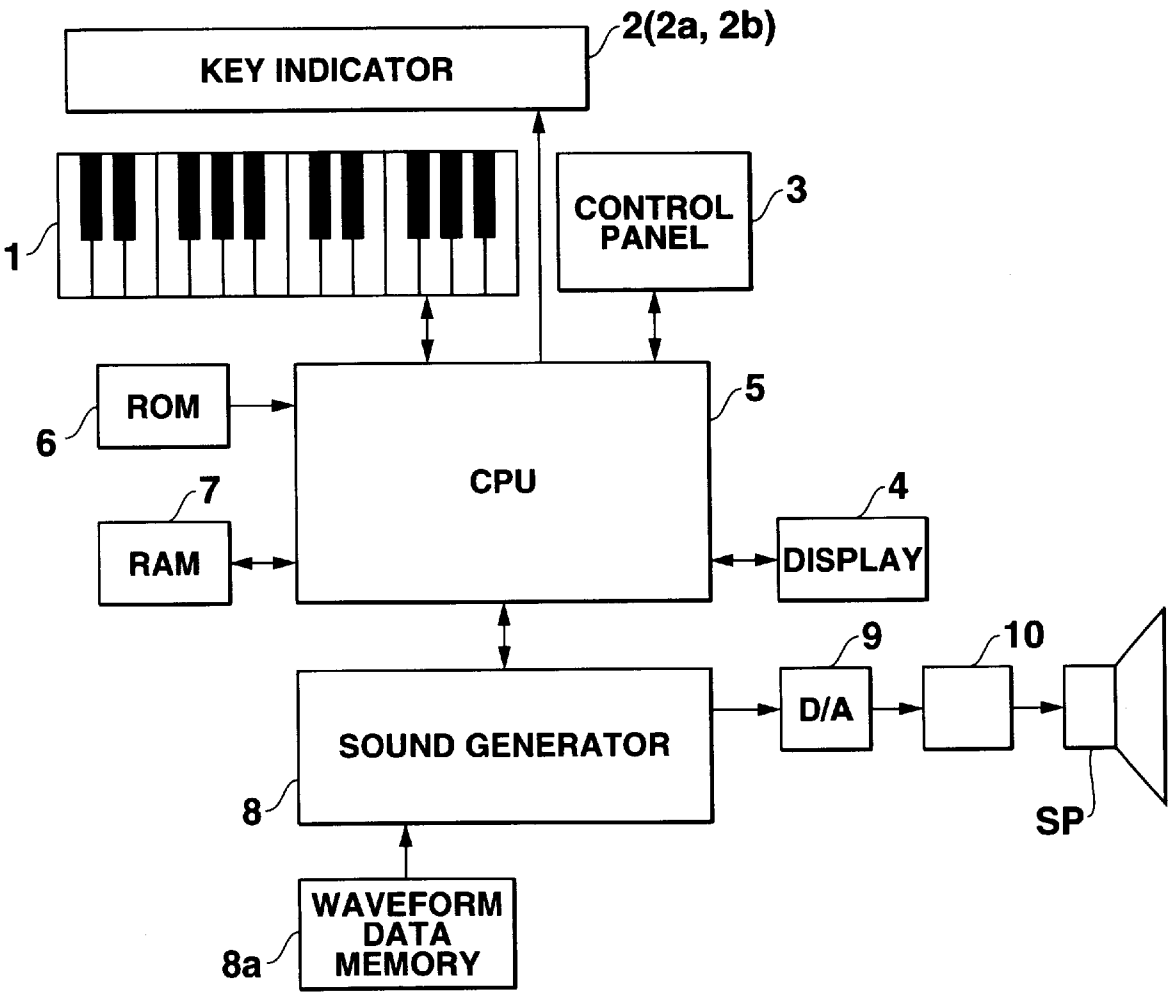
FIG. 1 is a block diagram showing the structure of a musical instrument according to a first embodiment of the present invention.

FIG. 1 is a diagram showing the structure of a keyboard musical instrument hereinafter, referred to as instrument) according to a first embodiment of the present invention. In FIG. 1, a reference numeral 1 denotes a keyboard which generates play information such as key-on/key-off signals, key codes, etc. in accordance with key depression (play).

A reference numeral 2 denotes a key indicator which performs key indication under control of a CPU 5. The key indicator 2 comprises light emitting means 2*a* (not shown) which are placed beneath each key which is made of translucent resin or the like, and a driver 2*b* (not shown) which drives the light emitting means 2*a*. The driver 2*b* drives the light emitting means 2*a* in accordance with a light control signal supplied by the CPU 5 so that light emitting means 2*a* light keys to notify a user which keys should be pressed. The light emitting means 2*a* comprises, for example, LED (Light Emitting Diode) for red and blue lights.

A reference numeral 3 denotes a control panel on which various switches are arranged. The switches are: a power switch for turning on/off the instrument; a pattern selector switch for selecting a desired accompaniment pattern from a plurality of preset accompaniment patterns; a chord designation mode selector switch for selecting chord designation mode (aforementioned simple fingering mode or fingered chord mode); a start/stop switch for instructing start or stop of the guidance.

A reference numeral 4 denotes a display unit which comprises an LCD (Liquid Crystal Display) panel or the like. The display unit 4 displays modes and settings being active in accordance with a display control signal given by the CPU 5.

The CPU 5 controls the key indicator 2 to perform chord fingering guidance in accordance with selected chord designation mode when performing automatic accompaniment in accordance with selected accompaniment pattern. Operational features of the CPU 5 will be described later.

A reference numeral 6 denotes a ROM (Read Only Memory) which stores various programs to be loaded to the CPU 5, accompaniment pattern data for plural tunes, and a position search table TBL1 (described later). Each accompaniment pattern data segment includes chord data in accordance with chord progression corresponding to measures and beats as shown in FIG. 2. Each of the chord data segments represents root and chord construction.

The position search table TBL1 in the ROM 6 is a data table in which chord tone (chord position) for root position and inversions chord by chord. Of reference symbols in the TBL1, "R" represents root position, "I" represents first inversion whose root is 3rd, "II" represents second inversion whose root is 5th, and "III" represents third inversion whose root is 7th.

The position search table TBL1 will be referred in order to find smooth fingerings during the key indication mode. The TBL1 exemplified in FIG. 3 corresponds to chord progression shown in FIG. 2. In later-described key indication process, appropriate chord positions for smooth fingering are extracted in accordance with the chord progression, and key positions corresponding to the extracted chord positions will be indicated.

The structure of the instrument will now be described again with reference to FIG. 1. In FIG. 1, a reference numeral 7 denotes a RAM as a work area for the CPU 5. It temporarily holds various registers, flag data, and the like.

A reference numeral 8 denotes a known wave memory type polyphonic sound generator (tone generator) which is timeslot operational. The sound generator 8 reads out wave data representing predetermined tone from a waveform data memory (wave memory) 8*a* in accordance with a sound parameter signal supplied from the CPU 5, in order to generate voices (tones) for playing and for chords or bass patterns corresponding to accompaniment pattern.

A reference numeral 9 denotes a DAC (Digital/Analog Converter) which converts an output signal of the sound generator 8 into an analog signal, and supplies the analog signal to a following sound system 10.

The sound system 10 includes, for example, a filtering circuit, an amplifier circuit, and the like. That is, the sound system 10 performs noise reduction onto the input analog signal and amplifies it before outputs it to speakers SP.

(2) Operations

Operations of the instrument according to the first embodiment will now be described with reference to FIGS. 4 to 7D. This section includes a first part describing operations of a main routine as a fundamental operation, and a second part describing a fingering guidance routine which is an essential task of the present invention.

1. Main Routine

Figure 4:
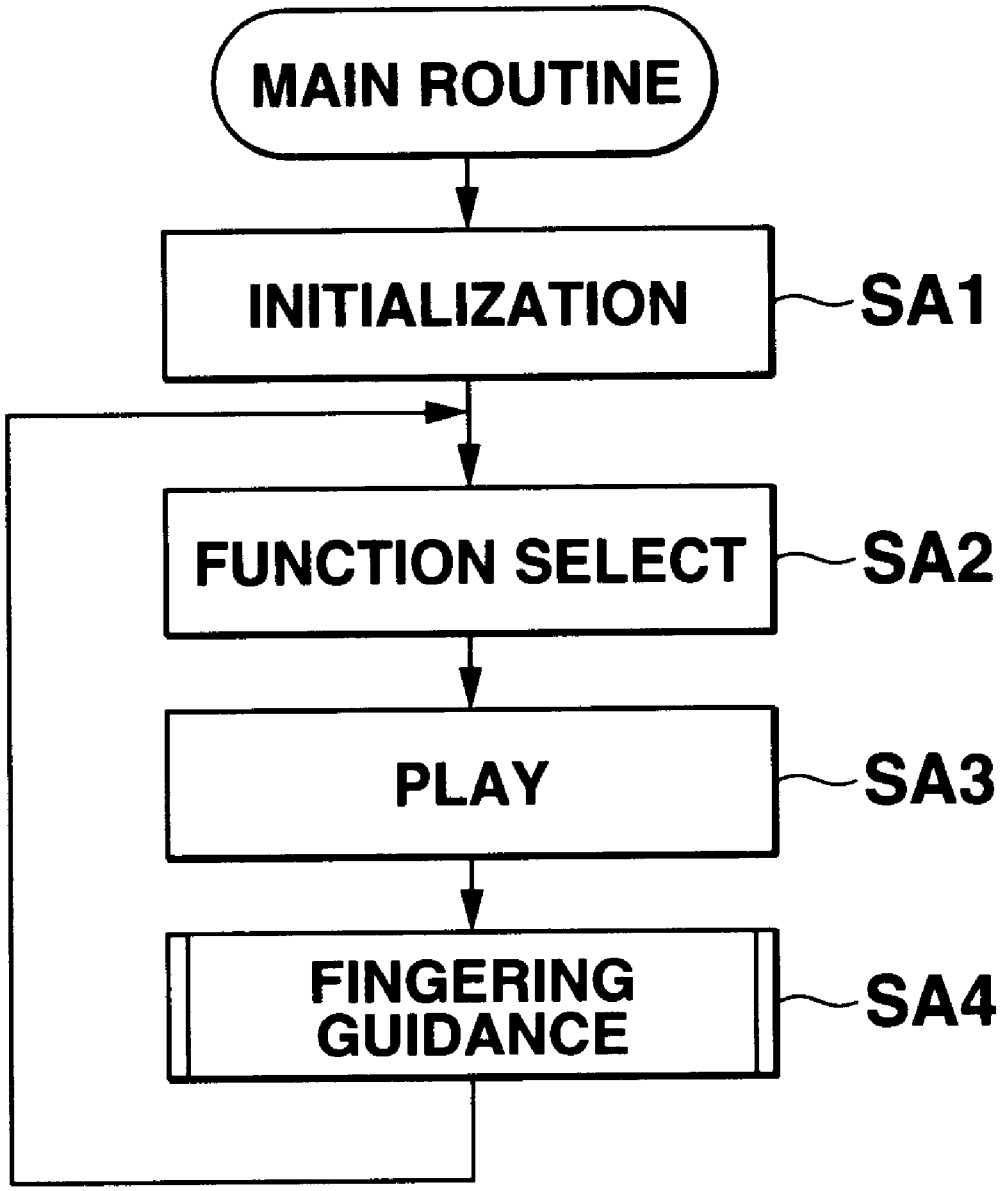
FIG. 4 is a flowchart for explaining steps to be executed in a main routine.

After the instrument is turned on, the CPU 5 loads predetermined control program from the ROM 6 to execute the main routine shown in FIG. 4. At initialization step (step SA1; FIG. 4), the CPU 5 resets various registers or flags to be set to the RAM 7, and instructs the sound generator 8 to reset its registers to 0.

After the initialization step, the CPU 5 detects functions selected through the various switches on the control panel 3 (step SA2). In this step, the CPU 5 detects, for example, which accompaniment pattern is selected through the pattern selector switch or which chord designation mode is selected through the chord designation mode selector switch.

Then the CPU 5 controls the sound generator 8 to sound or mute voices in accordance with key operation by a player (step SA3).

The CPU 5 also performs fingering guidance processing (step SA4) with controlling the key indicator 2.

The above steps SA2 to SA4 are repeatedly executed until the instrument is turned off, thus, sound playback and fingering guidance are performed in accordance with the key and switch operations.

2. Fingering Guidance Routine

Steps to be executed in the fingering guidance routine will now be described with reference to FIGS. 5 to 8. The following explanation describes a case where an accompaniment pattern shown in FIG. 2 has been selected at step SA2 under the fingered chord mode.

Figure 5:
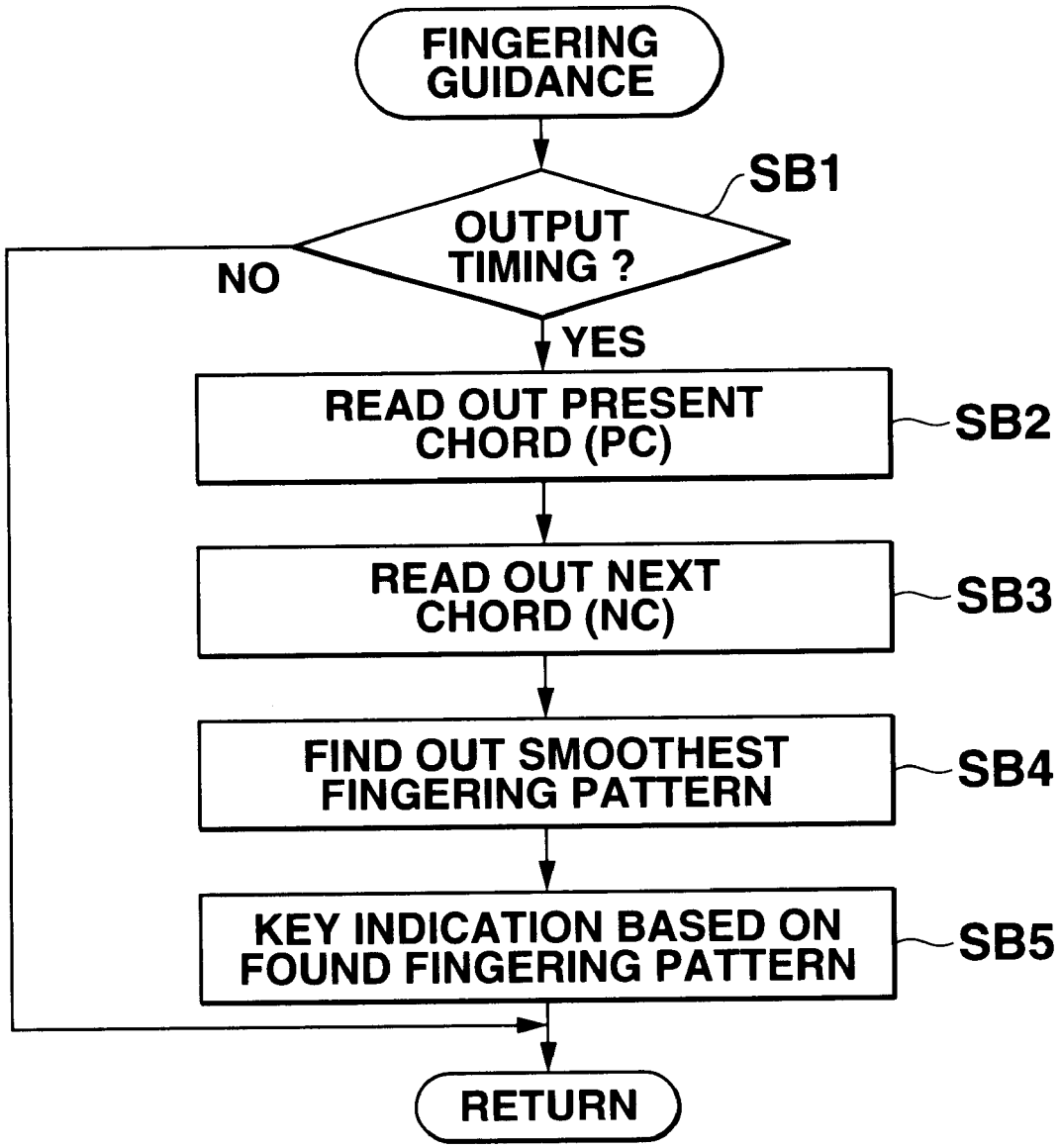
FIG. 5 is a flowchart for explaining steps to be executed in a fingering guidance routine.
Figure 6A:
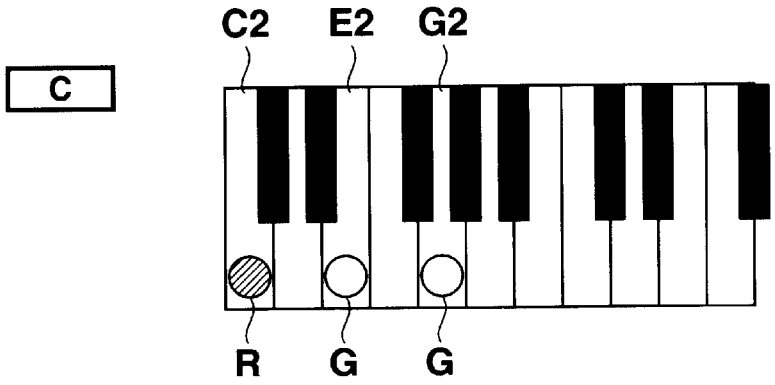
FIGS. 6A to 6D are diagrams for explaining operations in accordance with the fingering guidance routine.
Figure 6B:
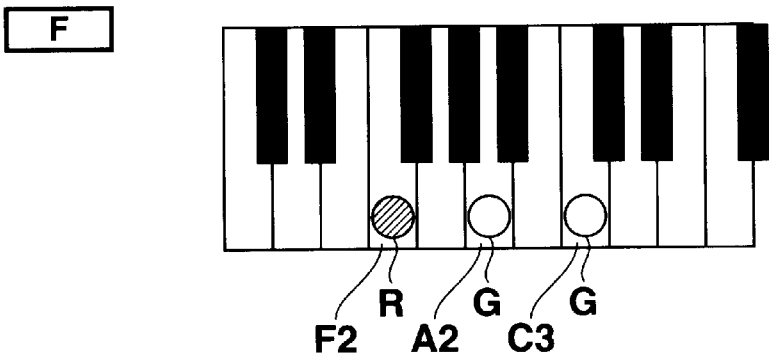
Figure 6C:
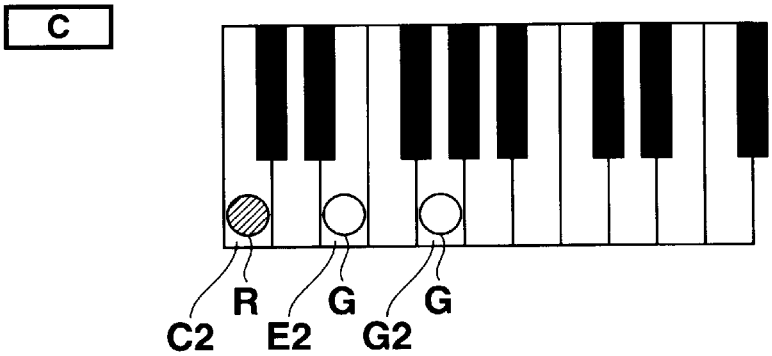
Figure 6D:
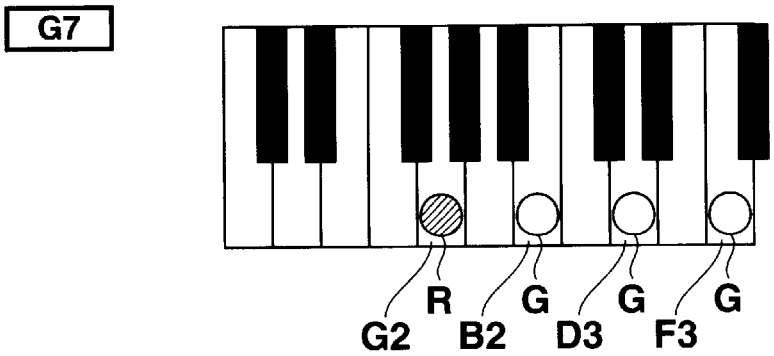
Figure 7A:
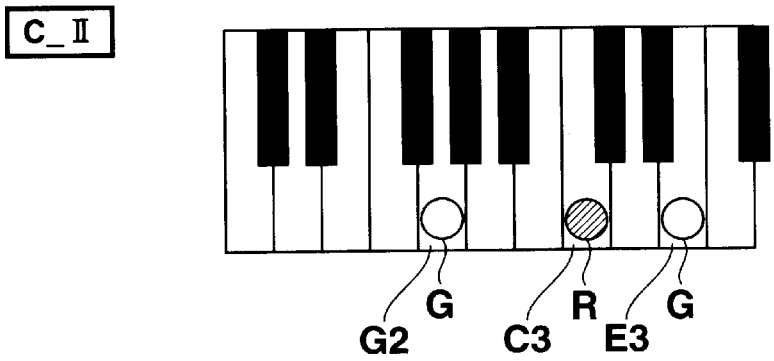
FIGS. 7A to 7D are diagrams for explaining operations in accordance with the fingering guidance routine.
Figure 7B:
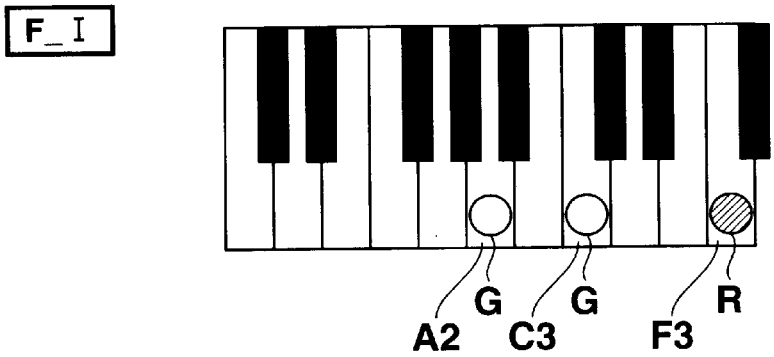
Figure 7C:
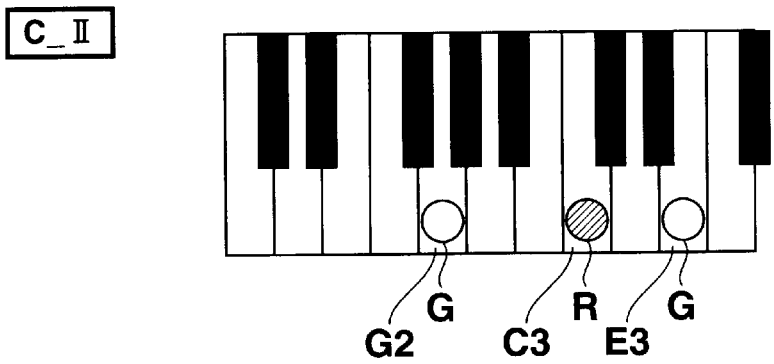
Figure 7D:
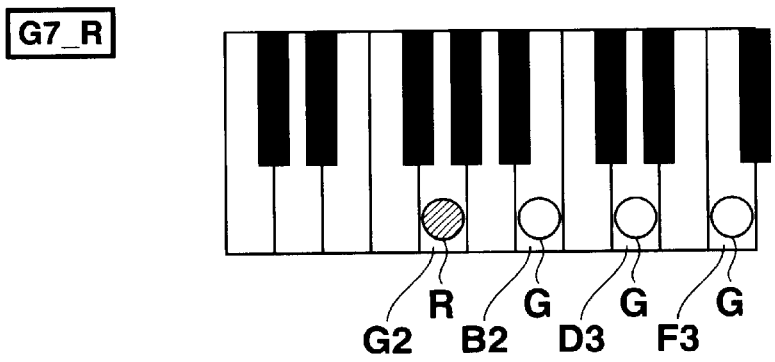

When the fingering guidance mode starts at step SA4 under the above condition, the CPU 5 determines whether it is timing at which the accompaniment pattern should be output or not (step SB1; FIG. 5). If it is not output timing (SB1: N), the routine is terminated.

If it is output timing (SB1: Y), the CPU 5 reads out chord data corresponding to first beat in the accompaniment pattern shown in FIG. 2 from the ROM 6 (step SB2). The CPU 5 stores the read-out chord data in the RAM 7 as register PC, and sets an address pointer to next beat to ready for the next chord data reading.

The CPU 5 reads out chord data of the beat indicated by the address pointer, and stores the read-out chord data in the RAM 7 as register NC (step SB3).

The CPU 5 accesses the position search table TBL1 to find out appropriate positioning (chord tone) for the chord data PC to realize smoothest fingering (step SB4).

That is, the CPU 5 analyzes the relationship between the chord data PC and NC to determine which inversion type (root position or inversions I, II, or III) of the chord data PC realizes the smoothest fingering.

The CPU 5 generates a key indication signal which designates keys to be pressed, based on the found positioning, and generates a lighting control signal corresponding to the key indication signal (step SB5). The lighting control signal is supplied to the key indicator 2 to perform fingering guidance.

Effects of the fingering guidance will now be exemplified with reference to FIGS. 6A–6D and 7A–7D. In FIGS. 6A to 7D, reference symbols "R" represents red light which indicates Root, and "G" represents green light which indicates chord tones other then Root. FIGS. 6A to 6D shows fingering pattern in a case where the chord progression shown in FIG. 2 is played with only root position chords. As illustrated, this case requires a player to move his/her hand widely as chords progress. FIGS. 7A to 7D shows another fingering pattern in a case where playing the same chord progression with using inversions. As illustrated, the inversions realize less movement of fingering pattern, thus, the fingering becomes smoother.

Second Embodiment (1) Structure

The structure of a keyboard musical instrument (hereinafter, referred to as instrument) according to a second embodiment will now be described.

Figure 8:
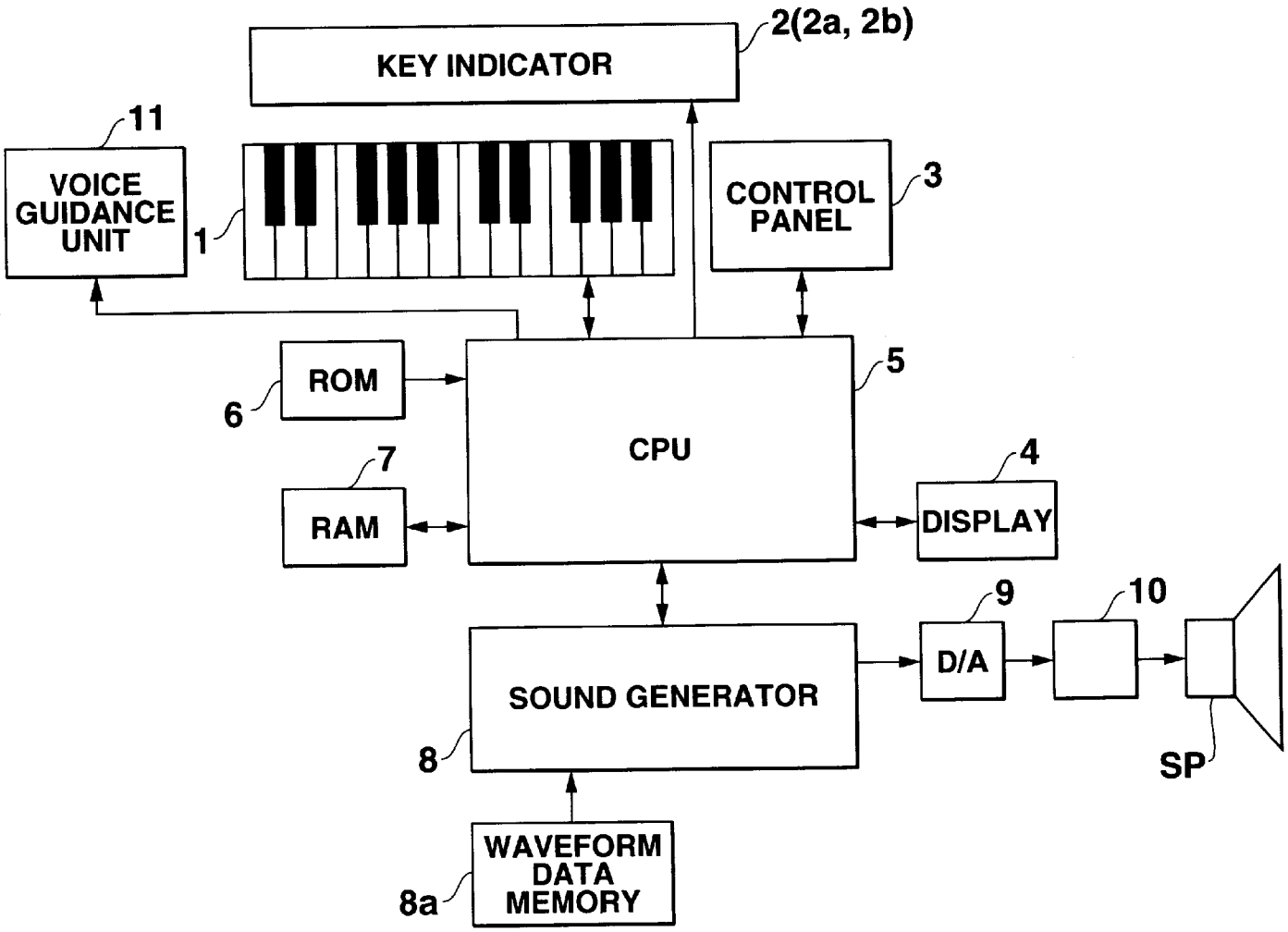
FIG. 8 is a diagram showing a musical instrument according to a second embodiment of the present invention.

Like or the same reference numerals as used in FIG. 1 are also used in FIG. 8 to denote corresponding or identical components. The difference between the first embodiment and the second embodiment is that the instrument according to the second embodiment comprises a voice guidance unit 11 which outputs synthesized human voices in accordance with instructions given by the CPU 5.

In the instrument according to the second embodiment, the ROM 6 stores an accompaniment pattern shown in FIG. 9 and a simple fingering guidance tables (hereinafter, referred to as guidance table) TBL2 shown in FIG. 10. The guidance tables TBL2 are prepared for the simple fingering mode. That is, TBL2 are tables attendant on the accompaniment patterns one of which is exemplified in FIG. 9, and store data representing which key is assigned to predetermined chord under the simple fingering mode. For example, if "Cadd9" is read out from the accompaniment pattern, a key of C which is a proper key will be lit.

(2) Operations

Operations of the instrument according to the second embodiment will now be described with reference to FIGS. 11 to 15D. This section progresses with describing a main routine, a.voice guidance routine, and a key indication routine.

1. Main Routine

Figure 11:
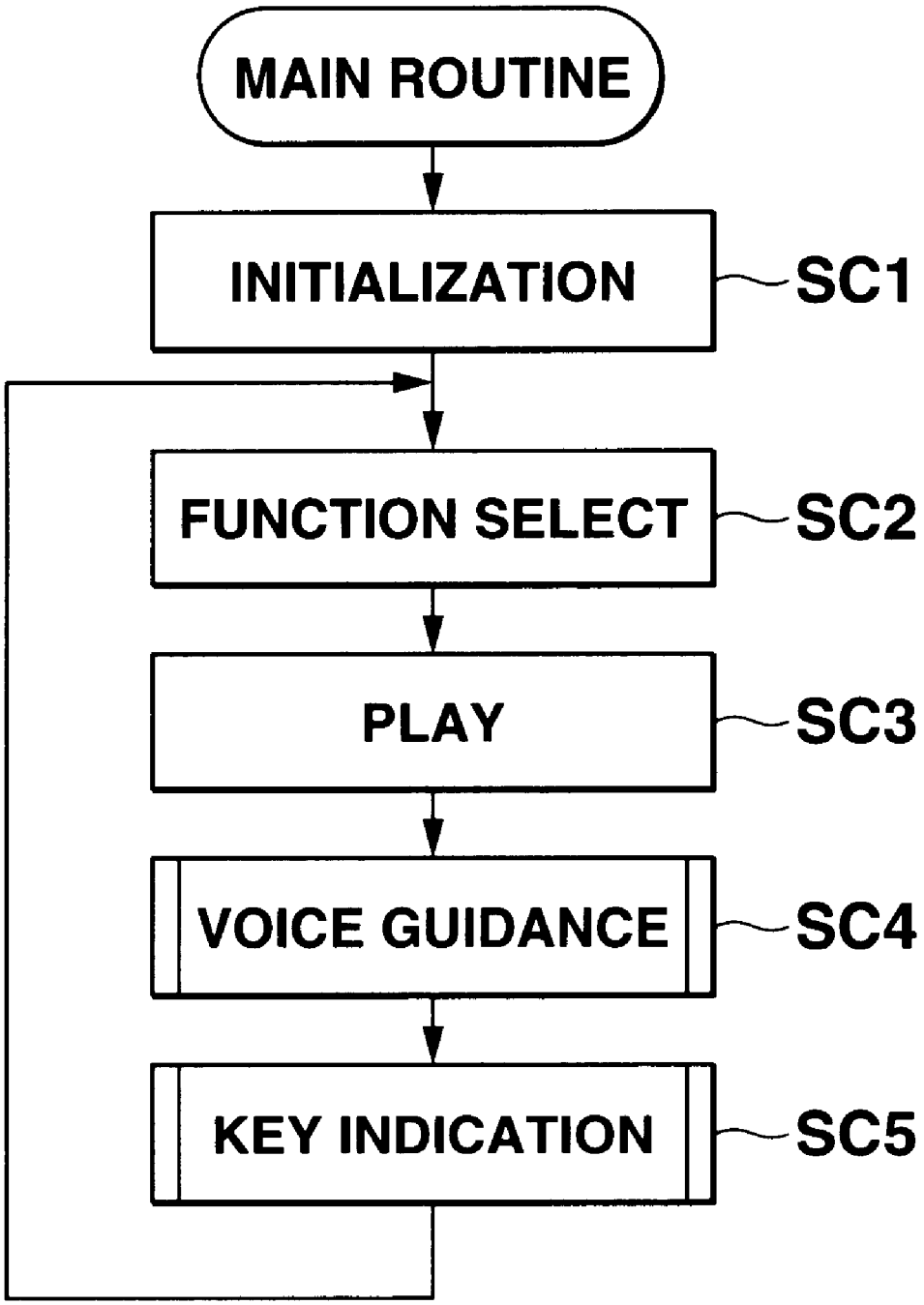
FIG. 11 is a flowchart for explaining steps to be executed in a main routine according to the second embodiment.

As well as the first embodiment, the CPU 5 loads predetermined control programs form the ROM 6 after the instrument is turned on, to execute the main routine shown in FIG. 11.

The CPU 5 resets various registers or flags to be set in the RAM 7, and instructs the sound generator 8 to reset its registers to 0 (Initialization step: SC1).

After the initialization step, the CPU 5 detects Functions selected through the various switches on the control panel 3 (step SC2). In this step, the CPU 5 detects, for example, which accompaniment pattern is selected through the pattern selector switch or which chord designation mode is selected through the chord designation mode selector switch.

Then the CPU 5 controls the sound generator 8 to sound or mute voices in accordance with key operation by a player (step SC3).

The CPU 5 controls the voice guidance unit 11 with being synchronous with chord progression of the accompaniment pattern, in order to perform voice guidance which guides key press timings for playing chords along the accompaniment pattern (step SC4).

The CPU 5 also performs fingering guidance processing (step SC5) with controlling the key indicator 2.

The above steps SC2 to SC5 are repeatedly executed until the instrument is turned off, thus, sound playback and fingering guidance are performed in accordance with the key and switch operations.

2. Voice Guidance Routine

Figure 12:
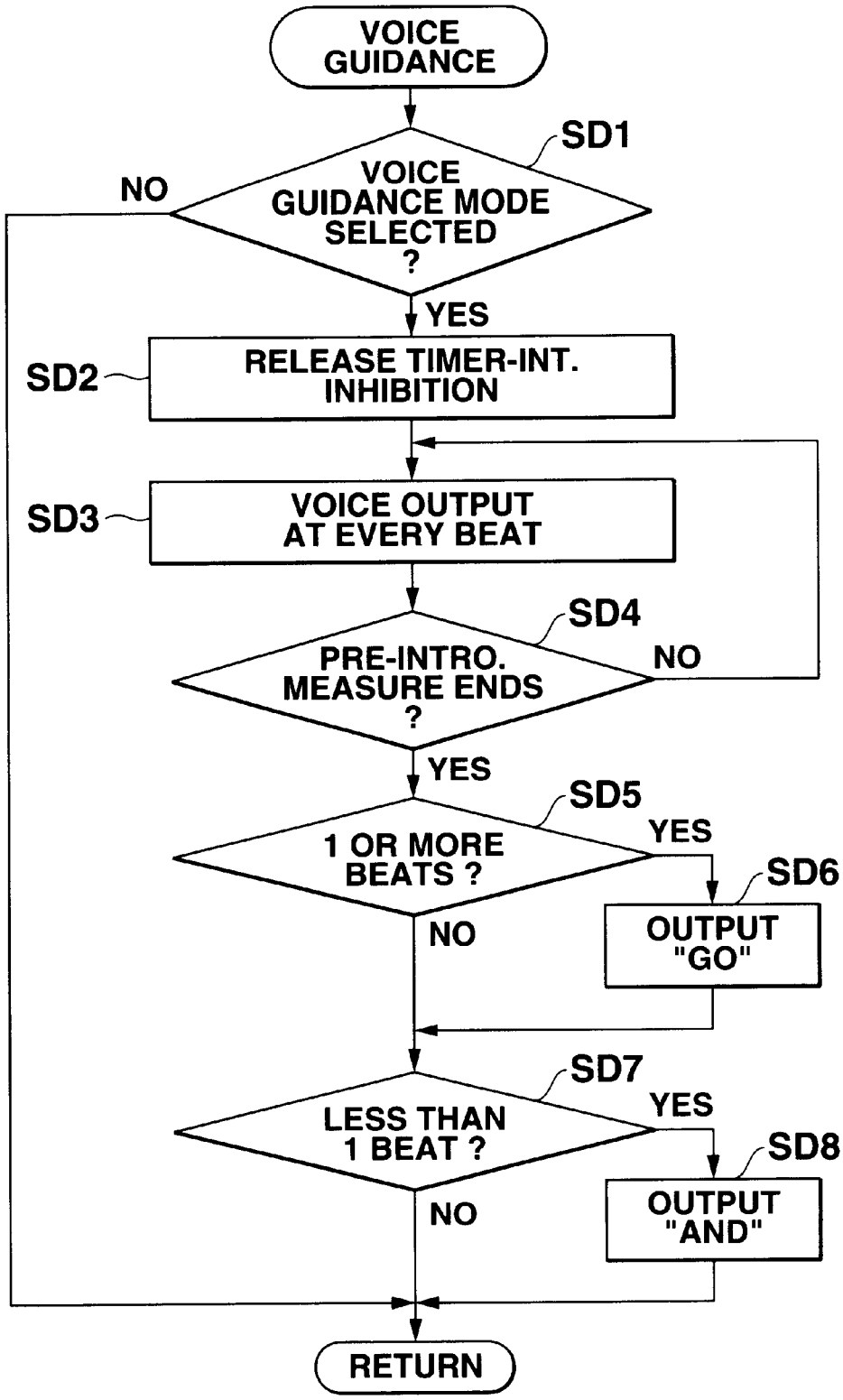
FIG. 12 is a flowchart for explaining a voice guidance routine according to the second embodiment.

Operations of the voice guidance routine (step SC4) will now be described with reference to FIGS. 12 to 13B. The following explanation describes a case where the accompaniment pattern shown in FIG. 9 was selected at step SC2, and key indication mode under the simple fingering mode has been set.

The CPU 5 determines whether voice guidance mode is selected or not (SD1; FIG. 12). If the voice guidance mode has not been selected (SD1: N), the routine is terminated.

If the voice guidance mode has been set (SD1: Y), the CPU 5 releases inhibition of timer-interruption (step SD2). According to the timer-interruption process (not shown), the CPU 5 generates interruption signals at predetermined intervals. And the CPU 5 instructs the voice guidance unit 11 to output voices being synchronous with beats during a pre-introduction measure (step SD3).

More precisely, the pre-introduction measure starts 1 beat before a read-out timing of the accompaniment pattern as shown in FIG. 13. During the pre-introduction measure, the voice guidance unit 11 outputs voices "one" at the 1st beat, "two" at the 2nd beat, and "three" at the 3rd beat, to notify the player beat timings of accompaniment playing (step SD3).

The voice guidance unit 11 outputs voice of "Go" at the 4th beat in the pre-introduction measure to notify the player a start timing of the first measure (introduction of the accompaniment) (step SD3).

That is, the voice guidance unit 11 counts up by voice at the 1st to the 3rd beats in the pre-introduction measure to impress the player with the beat timings, and outputs "Go" at the 4th beat to help the player to easily start the play.

When the pre-introduction measure ends (SD4: Y), steps for voice guidance during the following measures are carried out (steps SD5 to SD8).

Then, the CPU 5 determines the number of beats before the chord change in accordance with the chord progression of the accompaniment pattern. If it has 1 or more beats before the next chord (SD5: Y), the CPU 5 instructs the voice guidance unit 11 to output "Go" at a timing 1 beat before the next chord (step SD6).

Or, if the number of beat is less than 1 beat before the next chord (SD7: Y), the CPU instructs the voice guidance unit 11 to output "and" at a timing ½ beat before the next chord to notify the player that key depression timing for the next chord comes near (step SD8).

Figure 13A:
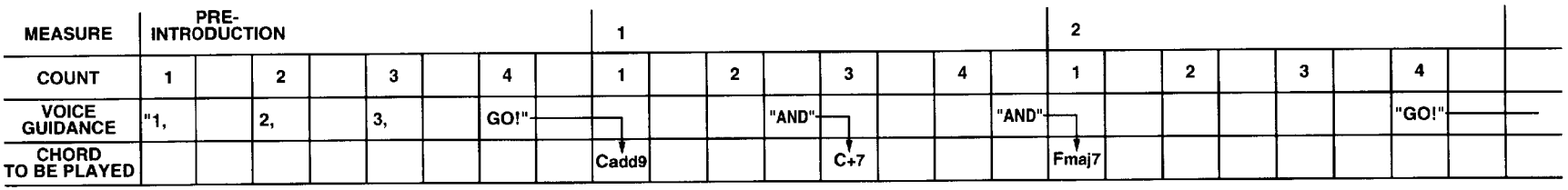
FIGS. 13A and 13B are diagrams for explaining operations in accordance with the voice guidance routine according to the second embodiment.
Figure 13B:
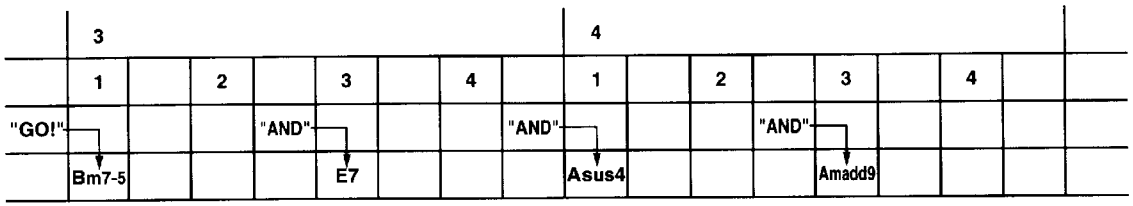

According to the above steps, the CPU 5 determines the voice guidance to be output whether "Go" or "and" based on the number of beats before the next chord, and the voice guidance unit outputs them as shown in FIGS. 13A and 13B.

3. Key Indication Routine

Figure 14:
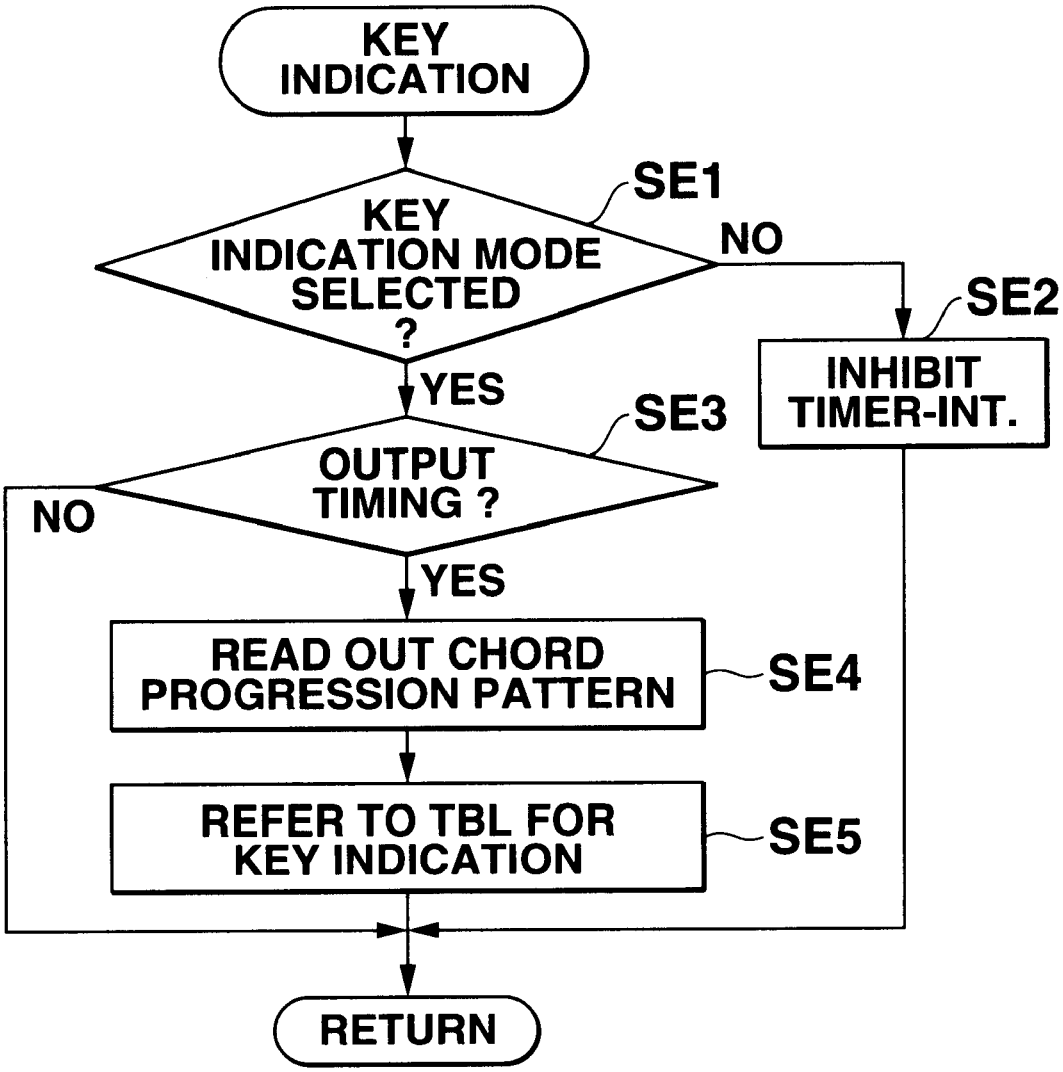
FIG. 14 is a flowchart for explaining steps to be executed in a key indication routine according to the second embodiment.
Figure 15A:
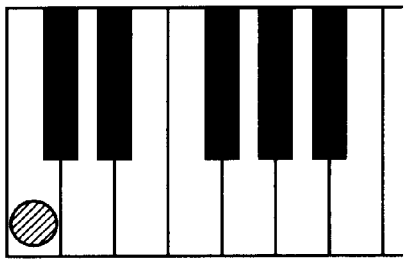
FIGS. 15A to 15D are diagrams for explaining operations in accordance with the key indication routine according to the second embodiment.
Figure 15B:
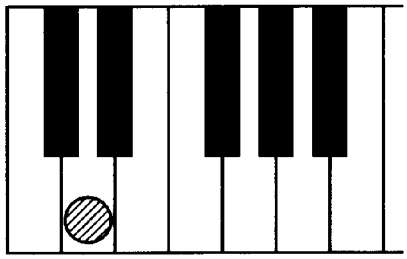
Figure 15C:
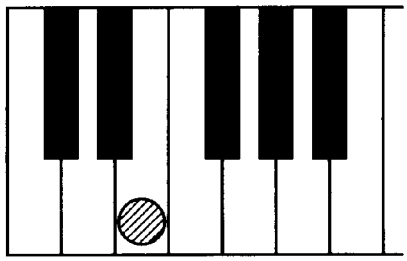
Figure 15D:
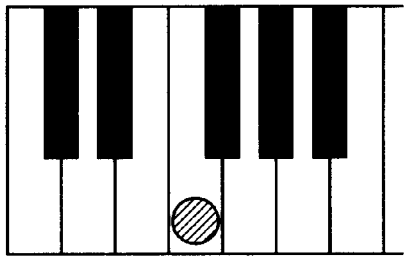

Operations of the key indication routine (step SC5) will now be described with reference to FIGS. 14 to 15D.

The CPU 5 determines whether the key indication mode is selected or not (step SE1; FIG. 14).

If the key indication mode has not been selected (SE1: N), the CPU 5 quit the timer-interruption, that is, the timer-interruption which was invoked at step SD2 (see FIG. 12) is inhibited (step SE2), and the routine is terminated.

On the contrary, if the key indication mode has been selected (SE1: Y), the CPU 5 determines whether it is a proper timing for outputting the accompaniment pattern or not (step SE3). If it is not the proper timing to output the accompaniment pattern (SE3: N), the routine is terminated.

If it is the proper timing to output the accompaniment pattern (SE3: Y), the CPU 5 reads out chord data corresponding to first beat of the accompaniment pattern shown in FIG. 9, and sets the address pointer at next beat for next chord reading (step SE4).

The CPU 5 refers the guidance table TBL2 (see FIG. 10) to read out data representing which keys are assigned to the present chord data. The CPU 5 generates a light control signal corresponding to the assigned key data, and supplies it to the key indicator 2 for performing key indication under the simple fingering mode.

According to the second embodiment as described above, keys to be pressed under the simple fingering mode are lit as shown in FIGS. 15A to 15D while being synchronous with voice guidance outputs. That is, it is suitable for practicing playing accompaniment even if a player is a very beginner who is unfamiliar with chord playing.

Third Embodiment

A keyboard musical instrument (hereinafter, referred to as instrument) according to a third embodiment will now be described. Since the structure of the instrument according to the third embodiment is the same as that of the instrument described in the first embodiment, detailed explanation will be omitted.

Feature of the first embodiment was to determine whether the present chord should employ root position or inversion for smoothest fingering (less fingering pattern with reduced action) in consideration of the following chord.

The third embodiment features that it determines which chord position (root position or inversion) of the present chord is closest to the former chord.

That is, the inversion type (root position or inversion) of the present chord will be determined, so that fingering position of the determined inversion type is the closes to the fingering position of the former chord in order not to require a player to move his/her hand widely. This feature is helpful for the player to play chords with easier fingering.

Figure 16:
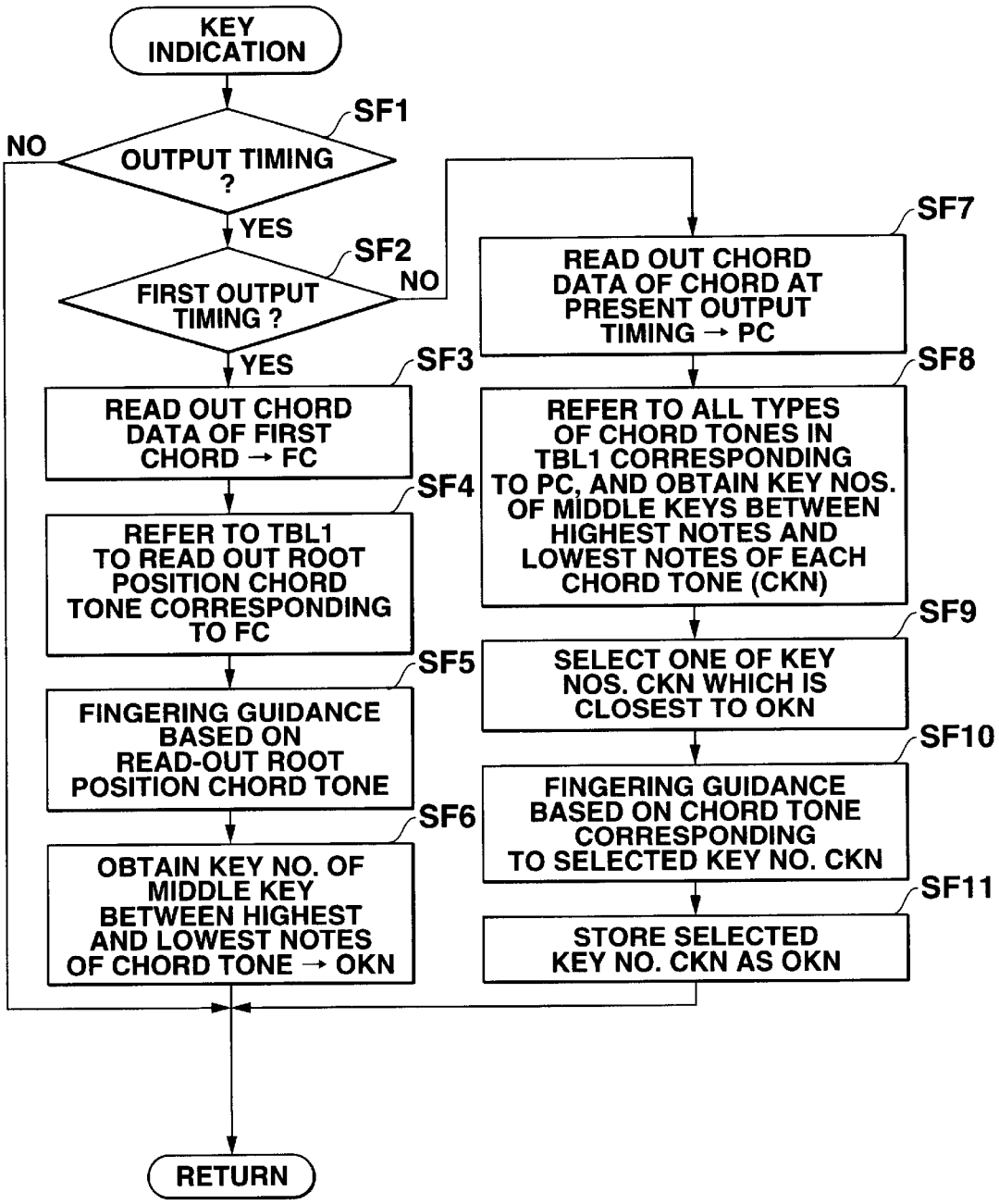
FIG. 16 is a flowchart for explaining steps to be executed in a key indication routine according to a third embodiment.

Operations of a key indication routine according to the third embodiment will now be described with reference to a flowchart shown in FIG. 16. The following explanation describes a case where the accompaniment patter shown in FIG. 2 has been selected as well as the first embodiment under the fingered chord mode.

As the CPU 5 starts the key indication routine as step SA4 of the main routine (see FIG. 4), the CPU 5 determines whether it is a proper timing for outputting the accompaniment pattern (step SF1).

If it is not the proper timing (SF1: N), the routine is terminated. On the contrary, if it is the proper timing (SF1: Y), the CPU 5 determines whether it is a first output timing or not, that is, whether it is a timing for reading out chord data representing a first (chord corresponding to a first beat) chord from the accompaniment pattern in the ROM 6 (step SF2).

If it is the first timing (SF2: Y), the CPU 5 reads out the chord data representing the first (chord corresponding to the first beat) chord from the accompaniment patter in the ROM 6, and stores it in the RAM 7 as a register FC (step SF3). The CPU 5 also sets the address pointer at the next beat in the accompaniment pattern to ready for the next chord data reading.

The CPU 5 refers to the position search table TBL1 (see FIG. 3) to read out chord tone (positioning pattern) of root position of chord corresponding to the chord data FC (step SF4).

Then the CPU 5 generates a key designation data which designate which keys should be pressed based on the read-out root position chord tone, and a light control signal corresponding to the key designation data. The CPU 5 supplies the light control data to the key indicator 2, and performs the key indication for the fingering guidance (step SF5).

The CPU 5 calculates middle key position (key No.) of the chord concerned. More precisely, the CPU 5 obtains key Nos. of the highest and the lowest notes of the chord concerned, and analyzes them to find out the key No. of a key which is at middle position between keys of the highest and the lowest notes. The CPU 5 stores the found key No. of the middle key in the RAM 7 as a register OKN (step SF6), and terminates the routine.

If the next output timing arrives (SF2: N), the CPU 5 refers to the address pointer to find out which chord data should be presently dealt with. The CPU 5 reads out the chord data concerned from the accompaniment pattern, and stores it in the RAM 7 as a register PC (step SF7). The CPU 5 also sets the address pointer at the chord data corresponding to the next beat.

Then the CPU 5 refers to the position search table TBL1 (see FIG. 3) to read out all chord tone patterns (that is, root position, and inversion types I, II and III) of the chord corresponding to the chord data PC. The CPU 5 analyzes each of the read-out chord tone patterns to obtain key Nos. of middle keys CKN of the each chord tone pattern based on the highest notes and the lowest notes of them (step SF8).

Then the CPU 5 analyzes the obtained key Nos. CKN to select one which is the closest to the key No. OKN (step SF9).

The CPU 5 generates key designation data which designate keys to be pressed based on the chord tone corresponding to the selected key No. CKN selected at step SF9, and supplies a light control signal corresponding to the key designation data to the key indicator 2, thus, key indication is performed.

Accordingly, the CPU 5 determines chord form (root position or inversion) of the present chord, which is the closest to the former chord, and indicates it.

Finally, the CPU 5 stores the selected key No. CKN selected at step SF10 in the RAM 7 as the register OKN (step SF11), and terminates the routine.

According to the third embodiment as described above, the CPU 5 determines the chord form (root position or inversion) of the present chord, which is the closest to the former chord, and indicates it, thus the player can play chords easily with the minimum hand movement.

Instead of the above described way to find a middle note in a chord tone set based on the key No., the middle note may be determined based on pitch differences in the chord tone set.

The above described embodiment may allow user's key customization, that is a user assigns some chords to desired keys in a key area for playing accompaniment. In this case, the CPU 5 may determine chord form (root position or inversion) of chords so as to be close to the designated keys.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. H11-363506 filed on Dec. 21, 1999 and including specification, claims, drawings and summary. The disclosure of the above Japanese Patent Application is incorporated herein by reference in its entirety.

What is claimed is:

1. A musical instrument for automatically playing a musical accompaniment comprising:

an accompaniment pattern storage unit which stores chord progression of a musical accompaniment;

a chord position storage unit which stores chord position data corresponding to the chords in said accompaniment pattern storage unit, said chord position data including chord tone sets corresponding to root positions and inverted positions for each chord;

a chord position determining unit which reads a first chord of the chord progression from said accompaniment pattern storage unit, and analyzes a second chord to be played next to the first chord, to determine whether the root position or the inverted position should be selected for smoothest chord playing;

a pitch indicator which indicates pitches in the chord tone set of the first chord in accordance with the chord position determined by said chord position determining unit;

a chord reader which reads out chords to be played from said accompaniment pattern storage unit being synchronous with predetermined tempo;

an operation conductor which conducts operations to designate chords read by said chord reader; and a timing indicator which indicates timings of performing the operation conducted by said operation conductor.

2. A musical instrument for automatically playing a musical accompaniment comprising:

an accompaniment pattern storage unit which stores chord progression of a musical accompaniment;

a chord position storage unit which stores chord position data corresponding to the chords in said accompaniment pattern storage unit, said chord position data including chord tone sets corresponding to a root position and inverted positions for each chord;

a note selector which extracts chord tone sets including a root position and inverted positions of a second chord in the chord progression from said chord position storage unit, and selects a note in the extracted chord tone sets of the second chord which is the closest to a first chord whose operation has already been conducted; and an operation conductor which indicates pitches of the chord tone set including said note selected by said note selector; wherein said selector previously obtains a first position of one of a note designator which designates a middle note between the highest and the lowest notes in the chord tone set of the first chord, obtains second positions of said note designator which designates middle notes between the highest and the lowest notes of the chord tone sets of the second chord, and selects one of the chord tone sets of the second chord including the note corresponding to one of the second positions which is the closest to the first position.

3. A method for automatically playing a musical accompaniment comprising the steps of:

reading a first chord in chord progression in accordance with a musical accompaniment to be played which is stored in an accompaniment pattern storage unit;

analyzing a second chord which follows the first chord to determine whether the first chord should employ a root position or an inverted position to realize smooth chord playing, and obtaining a chord tone set of the first chord corresponding to the determined chord position from a chord position storage unit which stores chord tone sets including root position and inverted positions for each chord corresponding to the chord progression stored in said accompaniment pattern storage unit;

guiding pitches of the determined chord tone set of the first chord; and indicating timings for performing the determined chords.

4. A method for automatically playing a musical accompaniment which conducts operations for playing chords which are read-out from an accompaniment storage unit which stores chord progression for a musical accompaniment, comprising the steps of:

extracting chord tone sets including a root position and an inverted position of a second chord in the chord progression from said chord position storage unit;

selecting a note in the extracted chord tone set of the second chord which is closest to a first chord whose operation has already been conducted; and indicating pitches of the chord tone set including said selected note, wherein said note selecting step previously obtains a first position of one of a note designator which designates a middle note between the highest and the lowest notes in the chord tone set of the first chord, obtains second positions of said note designator which designates middle notes between the highest and the lowest notes of the chord tone sets of the second chord, and selects one of the chord tone sets of the second chord which includes the note corresponding to one of the second positions which is the closest to the first position.

* * * * *